US005826515A

United States Patent [19]

Frable et al.

[11] Patent Number: 5,826,515

[45] Date of Patent: Oct. 27, 1998

[54] STAMPING DEVICE

[75] Inventors: Albert W. Frable, Bangor; Duane L. Hyrowich, Easton, both of Pa.

[73] Assignee: Binney & Smith Inc., Easton, Pa.

[21] Appl. No.: 790,705

[22] Filed: Jan. 29, 1997

[51] Int. Cl.[6] ..... B41K 1/42; B41F 5/00

[52] U.S. Cl. ..... 101/483; 101/327; 101/333; 101/405

[58] Field of Search ..... 101/483, 405, 101/406, 327, 333, 368

[56] References Cited

U.S. PATENT DOCUMENTS

| | | | |
|---|---|---|---|
| D. 247,261 | 2/1978 | Hörmann | D64/10 |
| D. 261,897 | 11/1981 | Bengtsson | D18/15 |
| D. 322,984 | 1/1992 | Mehaffey et al. | D18/15 |
| D. 352,521 | 11/1994 | Sculler et al. | D18/15 |
| D. 368,926 | 4/1996 | Petralia | D18/18 |
| 483,453 | 9/1892 | Hunt . | |
| 2,316,040 | 4/1943 | Wirfel | 101/327 |
| 2,453,201 | 11/1948 | Cushman | 15/134 |
| 2,584,908 | 2/1952 | Oblinger | 101/333 |
| 3,003,181 | 10/1961 | Rosenthal | 15/563 |
| 3,089,182 | 5/1963 | Lofgren | 15/563 |
| 3,251,299 | 5/1966 | Duke et al. | 101/334 |
| 3,345,674 | 10/1967 | DeGroft | 15/563 |
| 3,397,938 | 8/1968 | Juelss | 401/198 |
| 3,402,663 | 9/1968 | Funahashi | 101/327 |
| 3,403,623 | 10/1968 | Blackwood | 101/368 |
| 3,684,389 | 8/1972 | Eron et al. | 401/207 |
| 3,830,575 | 8/1974 | Lorenz | 401/259 |
| 3,832,947 | 9/1974 | Funahashi | 101/327 |
| 3,885,495 | 5/1975 | Funahashi | 101/327 |
| 3,952,653 | 4/1976 | McFarland | 101/327 |

(List continued on next page.)

FOREIGN PATENT DOCUMENTS

| | | | |
|---|---|---|---|
| 2294857 | 7/1976 | France . | |
| 2384627 | 10/1978 | France . | |
| 9894 | 4/1916 | United Kingdom | 101/333 |
| 1350320 | 4/1974 | United Kingdom . | |
| 2005597 | 4/1979 | United Kingdom | 101/327 |
| WO 82/00426 | 2/1982 | WIPO . | |

OTHER PUBLICATIONS

Four (4) photographs of product and photocopies of packaging for Crayola Mini Stampers Washable Markers by Binney & Smith Inc., available to consumers in approximately 1994.

Three (3) photographs of product for Liqui–Mark Stamperoos, available to applicant on approximately Jan. 20, 1997.

Four (4) photographs of product for stamp which attaches to the end of a pencil or pen, available to applicant on approximately Jan. 24, 1997.

Photocopy of a catalog entitled "A Leading Manufacturer of Rubber and Self–Inking Stamps" by Taiwan Stamp Enterprise Co. Ltd., Taiwan, R.O.C., available to applicant on approximately Jan. 24, 1997.

Photocopy of a catalog by Liqui–Mark of Westbury, New York, U.S.A. showing Stamperoos on p. 7, copyright 1997.

*Primary Examiner*—Eugene H. Eickholt

*Attorney, Agent, or Firm*—Leydig, Voit & Mayer, Ltd.

[57] ABSTRACT

A stamping device is provided for imprinting inked images onto an external object. The stamping device includes a housing having a first end, a second end, and a passageway therebetween. An image nib is attached to the second end of the housing and has an outwardly projecting face portion with at least one raised image formed thereon. An absorbent transfer medium or insert member is disposed within the passageway of the housing in adjacent relationship with respect to the image nib. In use, the passageway is adapted to receive a marking nib of a writing instrument, such as a marker, at the first end of the housing. When the marking nib of the writing instrument is inserted into the passageway, ink flows from the writing instrument to the absorbent insert member and then to the image nib. Once the image nib is saturated with ink, an inked reproduction of the raised images formed on the image nib may be transferred to an external object by pressing the outwardly projecting face portion of the image nib against the external object.

31 Claims, 18 Drawing Sheets

U.S. PATENT DOCUMENTS

| | | | |
|---|---|---|---|
| 3,971,315 | 7/1976 | Hansen | 101/333 |
| 4,022,127 | 5/1977 | Carlsson et al. | 101/327 |
| 4,054,093 | 10/1977 | Funahashi | 101/327 |
| 4,203,362 | 5/1980 | Underwood et al. | 101/327 |
| 4,229,115 | 10/1980 | Olinsky | 401/196 |
| 4,362,101 | 12/1982 | Ahrens | 101/327 |
| 4,583,875 | 4/1986 | Manusch et al. | 401/133 |
| 4,594,943 | 6/1986 | Nettesheim et al. | 101/327 |
| 4,649,819 | 3/1987 | Voto, Jr. et al. | 101/327 |
| 4,723,859 | 2/1988 | Kitoh | 401/199 |
| 4,735,143 | 4/1988 | Weir | 101/333 |
| 4,969,766 | 11/1990 | Nagle et al. | 401/202 |
| 5,014,617 | 5/1991 | Lesyk | 101/333 |
| 5,017,034 | 5/1991 | Stary et al. | 401/35 |
| 5,111,745 | 5/1992 | Wilson | 101/333 |
| 5,123,349 | 6/1992 | Beaver et al. | 101/333 |
| 5,136,968 | 8/1992 | Sarada et al. | 101/333 |
| 5,222,823 | 6/1993 | Conforti | 401/202 |
| 5,228,858 | 7/1993 | Fromm | 101/327 |
| 5,261,325 | 11/1993 | Bengtsson | 101/327 |
| 5,357,861 | 10/1994 | d'Arbelles et al. | 101/333 |
| 5,377,599 | 1/1995 | Wall et al. | 101/327 |
| 5,420,615 | 5/1995 | Witz et al. | 346/140.1 |
| 5,427,463 | 6/1995 | Bastiansen et al. | 401/134 |
| 5,435,245 | 7/1995 | Salisbury et al. | 101/405 |
| 5,448,950 | 9/1995 | Lowder et al. | 101/333 |
| 5,471,930 | 12/1995 | Wood | 101/405 |
| 5,579,692 | 12/1996 | Collier | 101/405 |

STAMPING DEVICE

FIELD OF THE INVENTION

The present invention relates generally to ink stamps and writing instruments and, more particularly, to a stamping device for imprinting images onto an external object with ink from a writing instrument or the like.

BACKGROUND OF THE INVENTION

Ink stamps for applying inked designs, alpha numeric characters, or other indicia onto external surfaces are well known in the art. Conventional ink stamps typically include a handle with a flat base portion and an elastomer marking face with raised marking indicia attached to the base portion of the handle. Such ink stamps, however, suffer from a number of deficiencies including the need for a separate ink pad for supplying ink to the elastomer marking face prior to transferring inked indicia to an external surface. In addition, ink stamps exist which are self inking. However, there remains a need for an ink stamp which utilizes ink from a writing instrument or the like.

OBJECTS OF THE INVENTION

Accordingly, a general object of the present invention is to provide a stamping device which is attachable to a writing instrument or the like.

Another object of the present invention is to provide a stamping device which utilizes ink from a writing instrument or the like to imprint images onto an external object or surface.

A more specific object of the present invention is to provide a stamping device which is attachable to and absorbs ink from a writing instrument so that inked images may be conveniently imprinted onto an external surface such as a piece of paper or the like.

A further object of the present invention is to provide a stamping device having the foregoing characteristics which is reliable, durable, and convenient to use.

These and other objects, features, and advantages of the present invention will become apparent upon reading the following detailed description of the exemplified embodiments and upon reference to the accompanying drawings.

SUMMARY OF THE INVENTION

The above objects are accomplished by providing a stamping device which includes a housing having a first end, a second end, and a passageway therebetween, an image nib attached to the second end of the housing and having an outwardly projecting face portion with a raised image formed thereon, and an absorbent transfer medium or insert member compressibly disposed within the passageway of the housing in contact with the image nib. In use, the passageway is adapted to receive a marking nib of a writing instrument, such as a marker, at the first end of the housing. When the marking nib of the writing instrument is inserted into the passageway, ink flows from the writing instrument to the absorbent insert member and then to the image nib. Once the image nib is saturated with ink, an inked reproduction of the raised image formed on the image nib may be transferred to an external object by pressing the outwardly projecting face portion of the image nib against the external object.

BRIEF DESCRIPTION OF THE DRAWINGS

In the drawings, wherein similar reference numerals denote similar elements throughout the several views.

While the present invention will be described and disclosed in connection with certain embodiments and procedures, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE INVENTION

Figure 1:
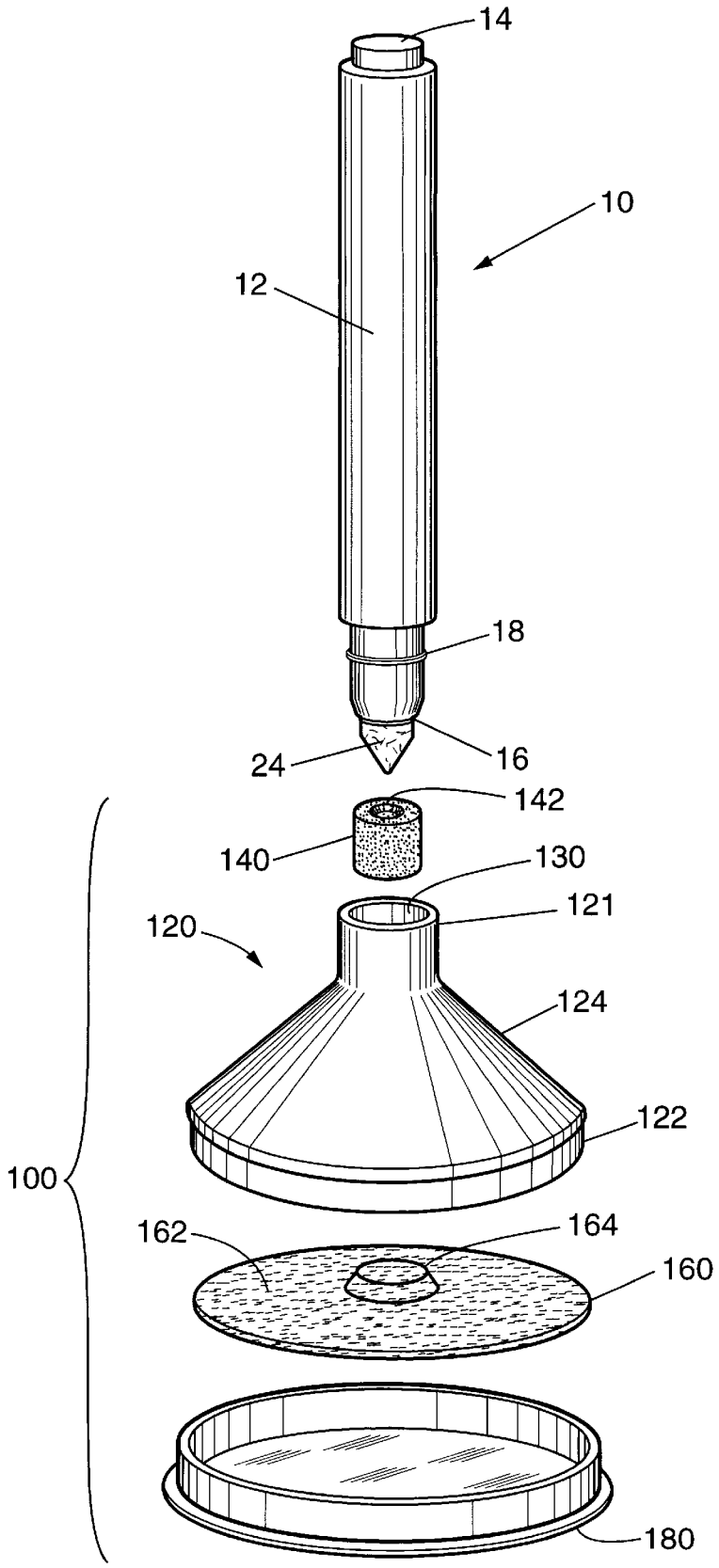
FIG. 1 is an exploded perspective view of a first embodiment of a stamping device in accordance with the present invention.
Figure 2:
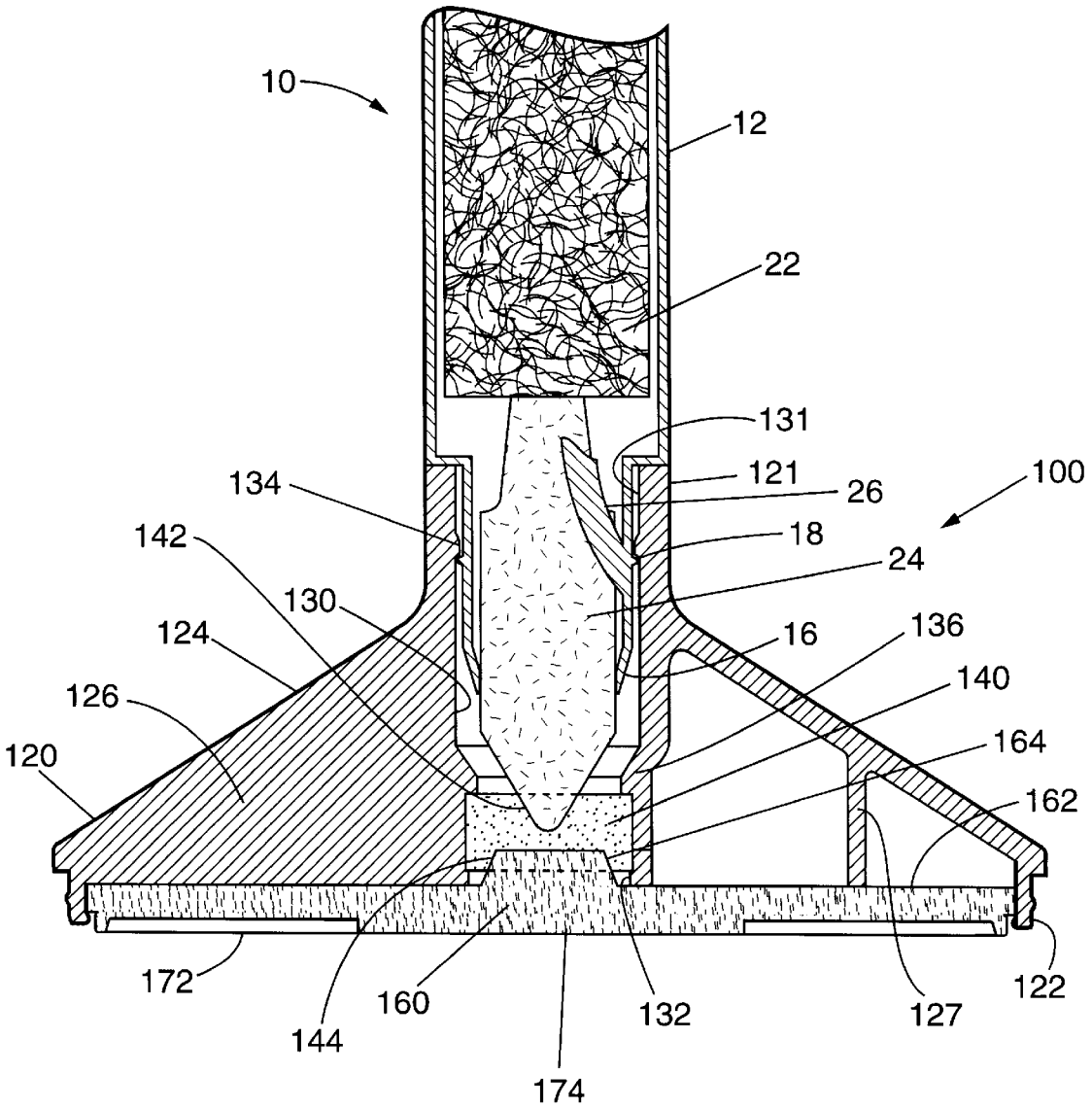
FIG. 2 is a cross-sectional view of the stamping device depicted in FIG. 1 with the lid removed for clarity and taken along line 2—2 of FIG. 3A.
Figure 3:
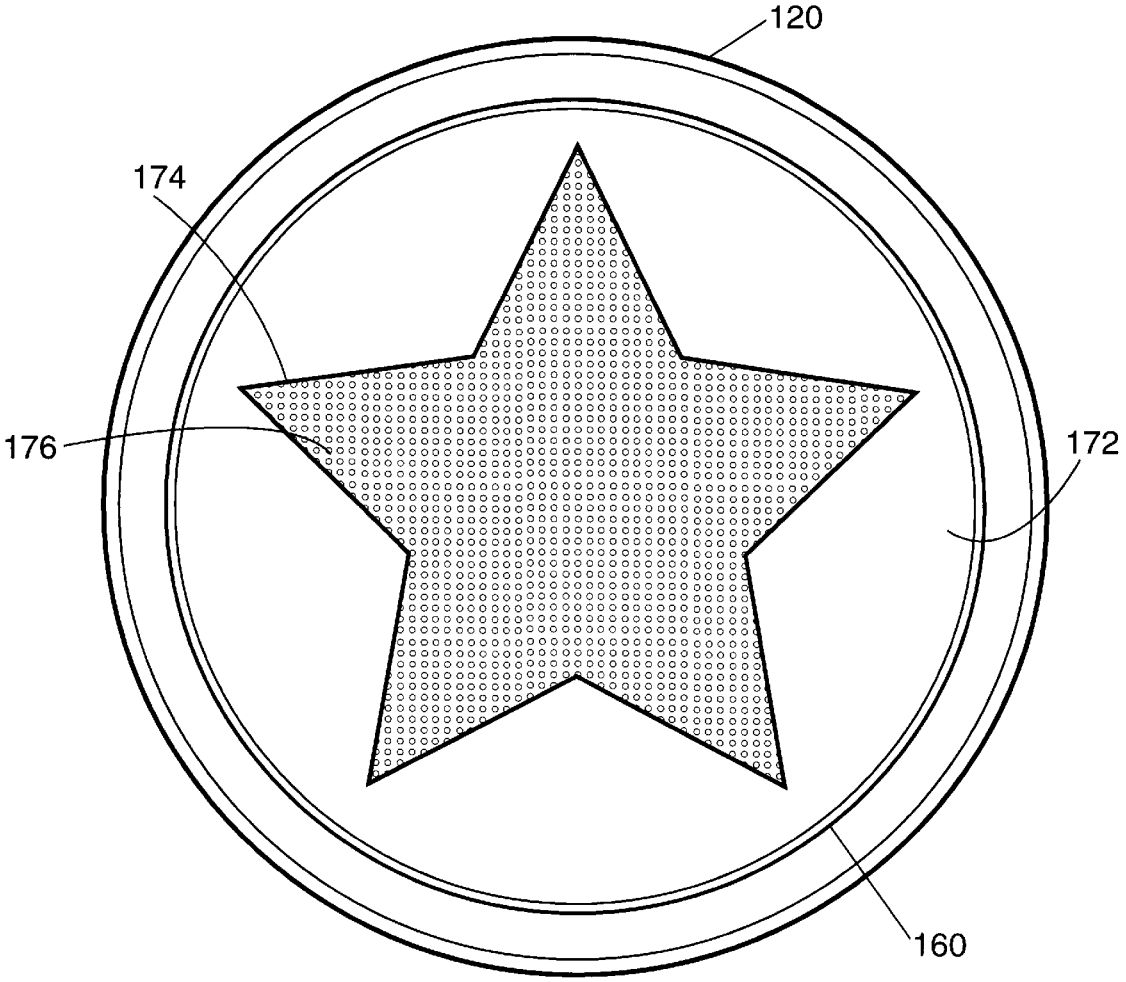
FIG. 3 is a bottom view of the stamping device shown in FIG. 1.

Turning now to the drawings and referring first to FIGS. 1–3, a first embodiment of a stamping device constructed in accordance with the present invention for imprinting inked messages, designs, or other indicia on an external object, such as a sheet of paper or the like, is generally designated by reference numeral 100. The stamping device 100 is specifically adapted to receive a writing instrument 10, such as a marker or the like, on one end and includes an absorbent image nib 160 with one or more raised images 174 on the opposite end. Once the stamping device 100 and the writing instrument 10 have been assembled together, ink flows from the writing instrument 10 and to the image nib 160 so that inked reproductions of the raised images 174 may be imprinted on the external object.

As is customary in the art, the writing instrument 10, such as a marker, includes a generally tube-like barrel 12 with a closed end 14 and an open end 16. As shown, for example, in FIG. 2, the barrel 12 of the writing instrument 10 accommodates a core of ink-saturated material 22 and a marking nib 24. The marking nib 24 is secured at the open end 16 of the barrel 12 in adjacent relationship with respect to the ink-saturated core 22. The marking nib 24 may be secured by a barb or barbs 26 which engage the marking nib 24 and prevent the marking nib from being withdrawn from the barrel. In use, capillary action between the marking nib 24 and the ink-saturated core 22 causes the marking nib 24 of the writing instrument 10 to become saturated with ink. Of course, once the marking nib 24 is sufficiently saturated with ink, the writing instrument 10 may be used for writing or marking purposes. In order to prevent the ink-saturated core 22 and marking nib 24 from drying out, a removable marker cap may be provided for enclosing the marking nib 24 when the writing instrument 10 is not in use. A small outwardly projecting ridge 18 formed near the open end 16 of the barrel 12 provides a snap-fit between the removable cap and the writing instrument 10. Of course, the marker cap should be removed before the marking nib 24 of the writing instrument 10 is inserted into the stamping device 100.

The writing instrument may also be a marker with a free ink system that contains a device which controls the venting and capillary pressure.

The first embodiment of the stamping device 100 includes a housing 120 having a first end 121, a second end 122, and a passageway 130 formed therethrough. The passageway 130 includes first and second ends 131 and 132 which correspond to the first and second ends 121 and 122 of the housing 120, respectively. As shown in FIGS. 1 and 2, the first end 131 of the passageway 130 is specifically adapted to receive the marking nib 24 of the writing instrument 10. The passageway 130 also tapers in a stepped manner from the first end 131 to the second end 132, with the second end 132 having a slightly smaller inner diameter than the first end 131.

In accordance with the present invention, the writing instrument 10 may either be fixedly or removably attached to the first end 121 of the housing 120. If the writing instrument is fixedly attached, any suitable attachment means may be utilized including, for example, gluing or welding. If, on the other hand, the writing instrument 10 is removably attached, the passageway 130 may include a small inwardly projecting flange 134 formed near the first end 131. The flange 134 interacts with the ridge 18 of barrel 12 to snap-fit the writing instrument 10 in proper position within the passageway 130 of the housing 120, as shown in FIG. 2. In use, this snap-fit between the ridge 18 of the writing instrument 10 and the flange 134 of the passageway 130 discourages the commingling of different ink colors by making it difficult to remove and replace a first writing instrument 10 with a subsequent writing instrument having a different ink color.

Once the writing instrument 10 and the housing 120 have been assembled together, these two components collectively constitute an elongated body having a closed end (i.e., the closed end 14 of the writing instrument 10), an open end (i.e., the second end 122 of the housing 120), and a reservoir (i.e., the barrel 12 of the writing instrument 10 and the passageway 130 of the housing 120) which contains absorbent insert members (i.e., the ink-saturated core 22 and the marking nib 24 of the writing instrument 10).

Figure 3A:
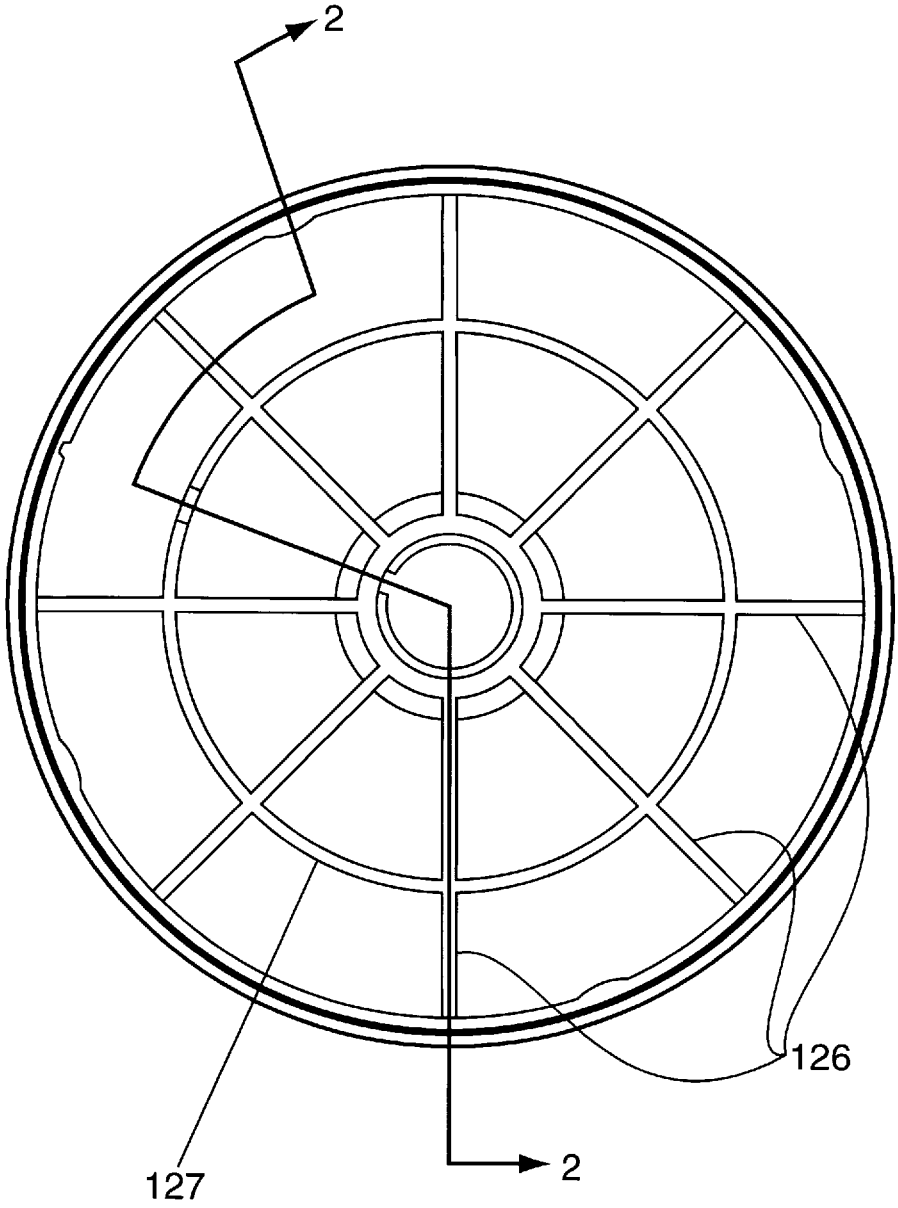
FIG. 3A is a bottom view of the stamping device without the image nib.
Figure 4:
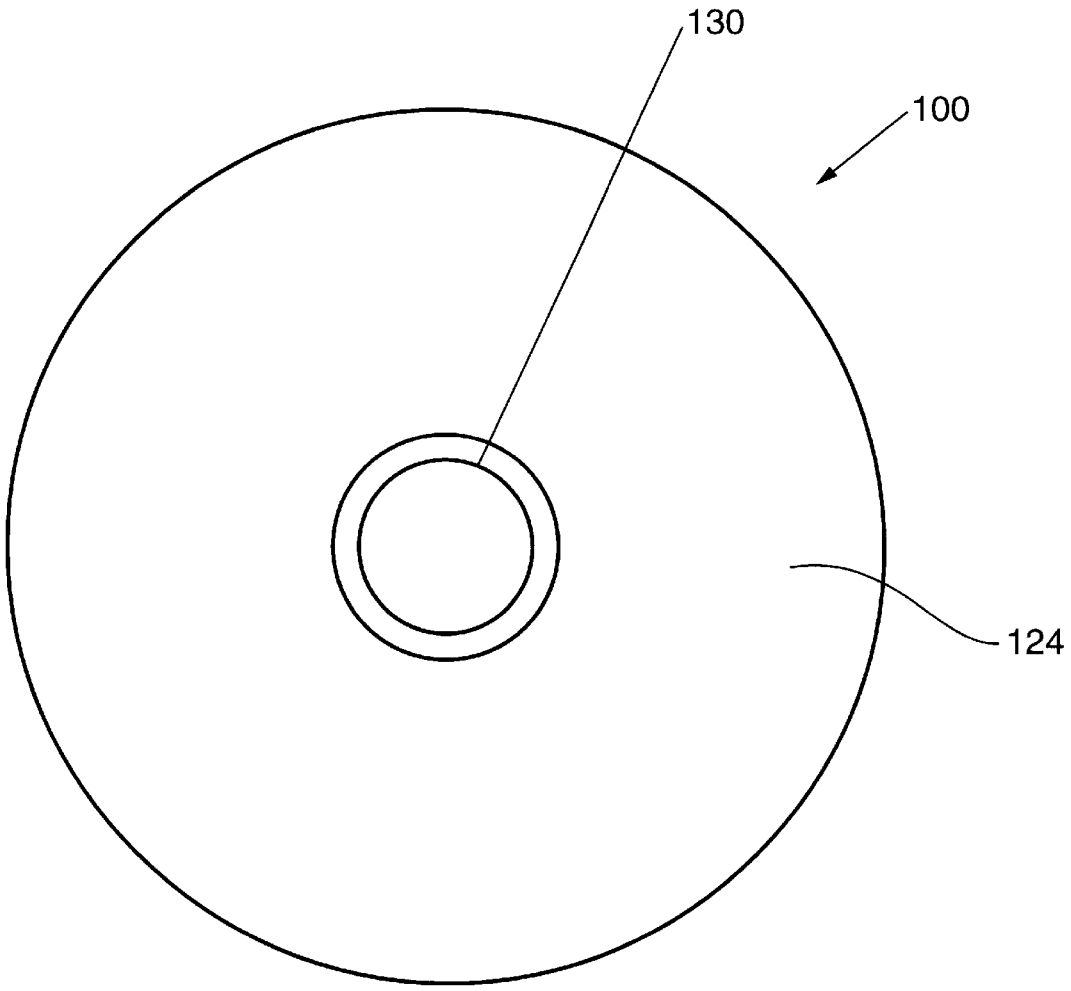
FIG. 4 is a top view of the stamping device shown in FIG. 1.
Figure 5:
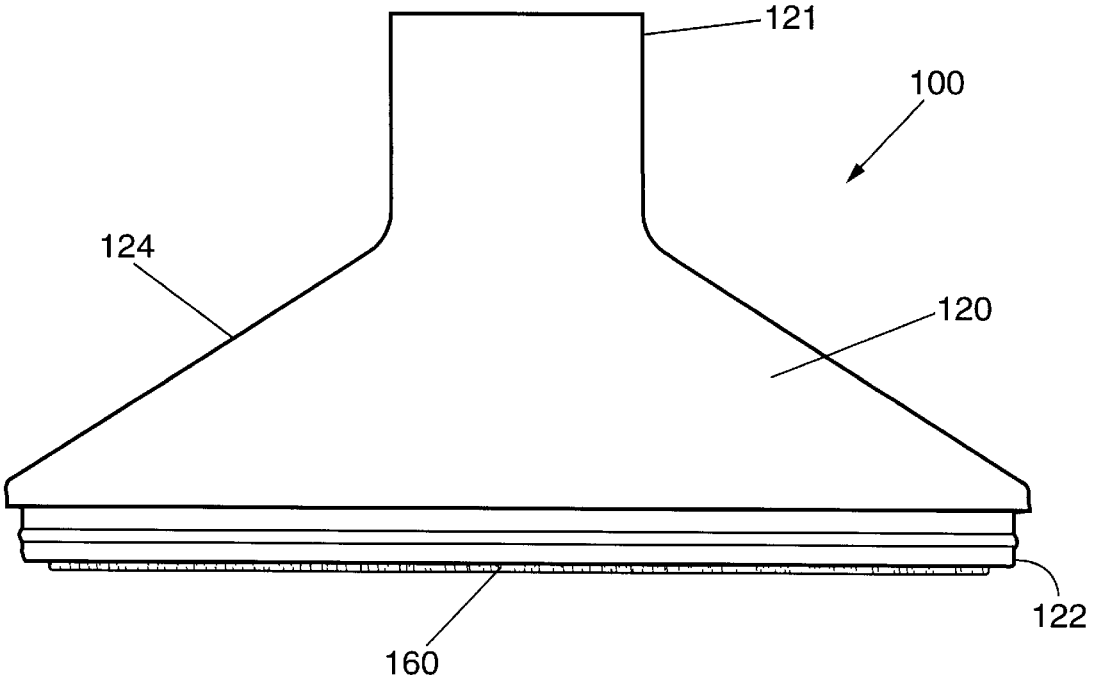
FIG. 5 is a side view of the stamping device shown in FIG. 1.

In order to provide a relatively stable base or foundation for the stamping device 100 and the attached writing instrument 10, the housing 120 includes a conical side wall portion 124 which gives the housing 120 a generally conical profile. Indeed, as shown in FIGS. 1 and 2, the second end 122 of the housing 120 is appreciably wider than the first end 121. In addition, the width allows a larger image on the image nib. In order to provide additional structural support to the housing 120, a plurality of spaced-apart web-like radial support members 126 are formed within the conical side wall 124. As best shown in FIGS. 2 and 3A, each radial support member 126 is generally triangular in shape and extends between the passageway 130 and the conical side wall 124 of the housing 120. Each radial support member 126 is also slightly spaced-apart from the second end 122 of the housing 120 at its lower end. In one embodiment, the housing may include eight radial support members. In addition, the housing 120 may include a concentric support member 127 as shown in FIGS. 2 and 3A.

In another embodiment, the housing of the stamping device may be the same diameter or cross-section as the diameter or cross-section of the marker. In yet another embodiment, the second end of the housing may be a smaller diameter or cross-section than the diameter or cross-section of the marker. In an additional embodiment, the second end of the housing may have the same configuration as the open end of the barrel, including the ridge 18. Thus, the cap from the marker could be used as a cap for the stamping device when the user positions the marker into the stamping device.

In order to prevent leakage, the housing 120 is preferably fabricated from a strong, fluid impervious, and durable material such as a thermoplastic, including but not limited to, polypropylene, polystyrene or polyethylene. Although a generally conical housing 120 formed of plastic material has been specifically described herein, it will be readily appreciated by those skilled in the art that other configurations and materials may alternatively be used for the housing 120.

The stamping device 100 also includes a transfer medium or insert member 140 disposed within the passageway 130 of the housing 120. The transfer medium 140 is positioned for communication with the marking nib 24 of the writing instrument 10 when the writing instrument is received by-the first end 131 of the passageway 130. As shown in FIG. 1, the transfer medium 140 has a generally cylindrical configuration which conforms to the inner diameter of the passageway 130. Once the transfer medium 140 is installed in the passageway 130 of the housing 120 and the image nib 160 is attached to the second end 122 of the housing 120, the transfer medium 140 is compressibly disposed between a ledge 136 formed near the second end 132 of the passageway 130 and the image nib 160, as shown in FIG. 2. The transfer medium 140 also compliantly receives the marking nib 24 of the writing instrument 10 and absorbs ink therefrom. The transfer medium 140 may have relatively flat upper and lower surfaces or the upper and lower surfaces may be formed to accept the image nib and the marking nib. For example, as shown in FIGS. 1 and 2, the transfer medium may include an indentation 142 which corresponds to the shape of the marking nib 24 and an indentation 144 which corresponds to the platform 164 on the image nib. In another embodiment where the transfer medium does not include the indentations, the transfer medium is sufficiently pliant to accept the marking nib in a fashion similar to FIG.

2. In order to promote the efficient transfer ink from the marking nib 24 of the writing instrument 10 to the transfer medium 140, the transfer medium 140 is preferably formed of a pliant and highly absorbent material such as porous polyester fiber, porous plastic or any other material which provides suitable capillary action and structural resiliency. The transfer medium may be made by Interflo Technologies, Inc. of 109–15 14th Avenue, College Point, N.Y. 11356, U.S.A. from an elastomeric polyolefin under Formulation No. 37-138-8 and Tool No. 2087X.

Figure 2A:
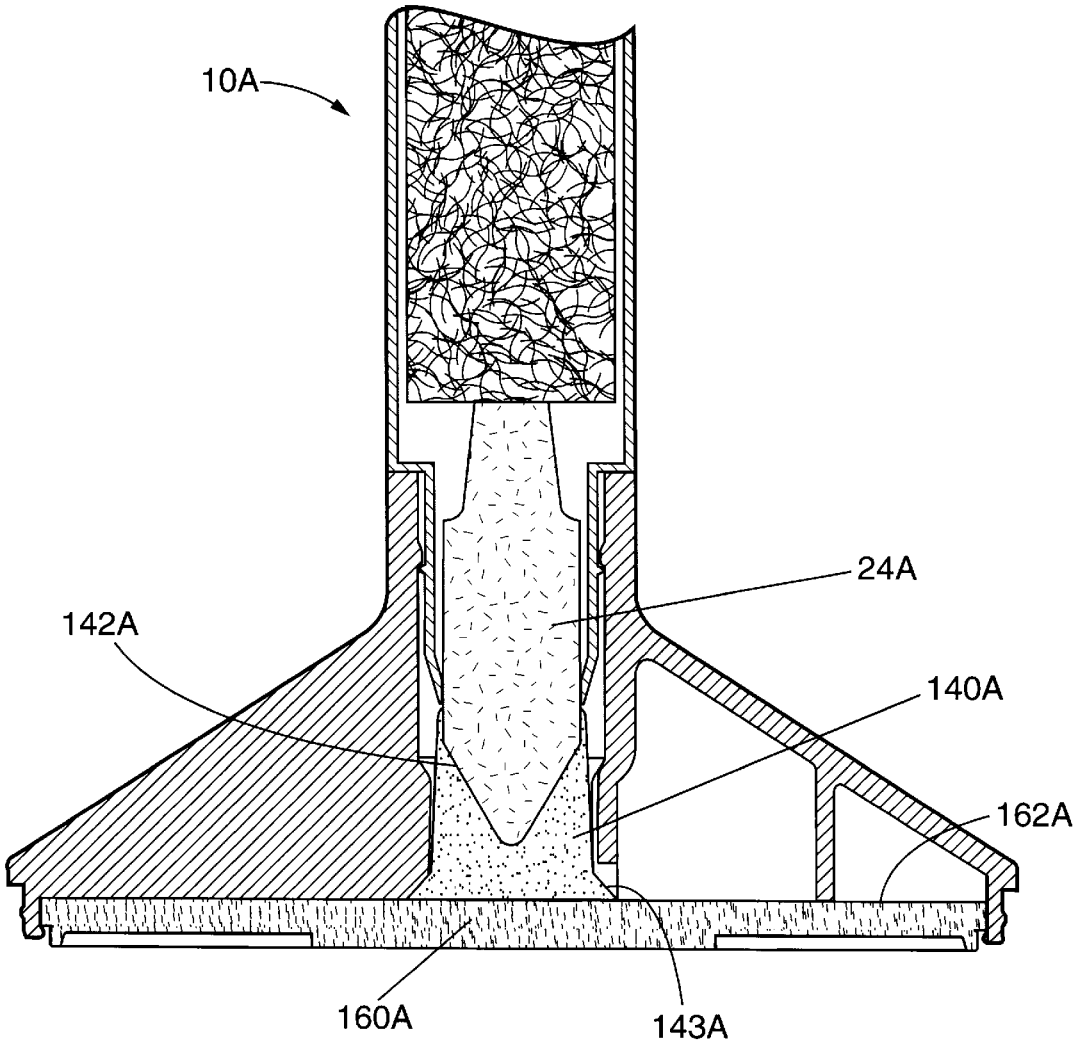
FIG. 2A is a cross-sectional view of another embodiment of the stamping device.

The stamping device 100 of the first embodiment further includes the image nib 160 which is generally disk-shaped in configuration. The image nib 160 is attached to the second end 122 of the housing 120 via a slight interference fit between the outer diameter of the image nib 160 and the inner diameter of the second end 122 of the housing 120. The image nib 160 also includes an inwardly projecting face portion 162 with a small circular platform 164 formed thereon, as shown in FIGS. 1 and 2. In another embodiment as shown in FIG. 2A, the image nib 160A will not include a platform and the image nib will have a relatively flat face portion 162A. The marking nib 24A will contact the transfer medium 140A and the transfer medium 140A will contact the image nib 160A when the writing instrument 10A is inserted into the stamping device. The transfer medium 140A has an indentation 142A which encompasses almost all of the exposed marking nib 24A to provide the maximum surface area to transfer the ink from the marking nib 24A to the transfer medium 140A. Similarly, the transfer medium 140A has a flange portion 143A which flares outward to provide additional surface area to the transfer ink from the transfer medium 140A to the image nib 160A.

As shown in FIG. 3, the image nib also includes an outwardly projecting face portion 172 with at least one raised image 174 formed thereon. The raised images 174, of course, may include alphanumeric characters, decorative designs, and/or other indicia. A list of the images includes, but is not limited to, a star, a Santa Claus, a snow man, a wreath, a view of earth, a flag, a balloon or a space ship.

When the image nib 160 is assembled to the second end 122 of the housing 120, as shown in FIG. 2, the inwardly projecting face portion 162 engages the web-like support members 126 of the housing 120, and the platform 164 is received by the second end 132 of the passageway 130 in side-by-side relationship with respect to the transfer medium 140. Thus, when the marking nib 24 of the writing instrument 10 is received by the first end 131 of the passageway 130, ink flows from the marking nib 24 of the writing instrument 10 to the transfer medium 140 to the platform 164 of the image nib 160. In order to provide sufficient durability and ink permeability, the image nib 160 may be made of a relatively rigid and highly absorbent material such as a sintered ultra high molecular weight polyethylene or any other material which provides suitable capillary action and structural rigidity. Because of these characteristics, the image nib 160 is not only durable to use, but also absorbs ink in a highly efficient manner. Specifically, the image nib may be made by Interflo Technologies, Inc. of 109–15 14th Avenue, College Point, N.Y. 11356, U.S.A. from a sintered ultra high molecular weight polyethylene under Formulation No. 38-122-5I-5A.

In order to use the stamping device, a user simply grips the housing 120 or the attached writing instrument 10 and presses the outwardly projecting face portion 172 of the ink-saturated image nib 160 against an external object, such as a piece of paper, to conveniently imprint inked reproductions of the raised images 174 onto the external object. In order to prevent the formation of ink puddles on the raised images 174 and the messy transferal of excess ink to the external surface, the raised images 174 may include texturing 176, such as, the raised dimples which are shown in FIG. 3.

As shown in FIG. 1, the stamping device 100 may also be provided with a lid 180 which sealingly covers the ink-saturated image nib 160 so as to prevent the evaporation of ink when the stamping device 100 is not in use. The lid 180 is received by and is removably attachable to the second end 122 of the housing 120. In another embodiment, the lid may be removable but attached to the housing by a living hinge or a tether. In yet another embodiment, the lid may be integral with the housing and the user pushes the image nib through an opening in the lid to expose the image nib.

Figure 6:
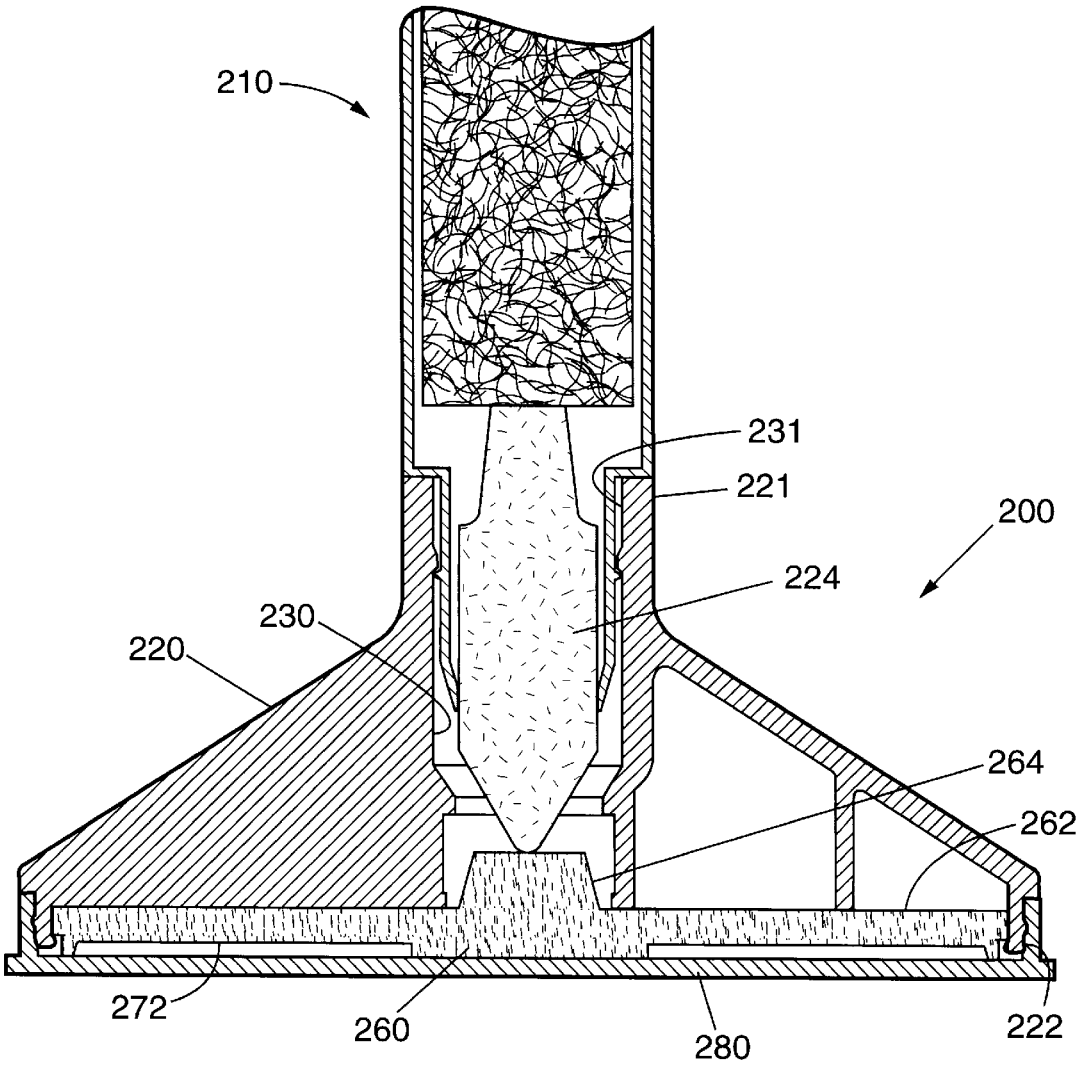
FIG. 6 is a cross-sectional view of another embodiment of the stamping device in accordance with the present invention.

Another embodiment of the stamping device is illustrated in FIG. 6. Structurally, this embodiment of the stamping device 200 is analogous to the first embodiment of the stamping device 100, except that the transfer medium 140 of the first embodiment has been eliminated and replaced with an elongated platform 264 formed on the inwardly projecting face portion 262 of the image nib 260. When the writing instrument 210 is attached to the housing 220 as shown in FIG. 6, the marking nib 224 of the writing instrument 210 communicates directly with the elongated platform 264, and not with an intermediate transfer medium. In this way, the marking nib 224 of the writing instrument 10 transfers ink directly to the image nib 260.

The image nib 260 may be formed of a material which provides appropriate capillary action and structural rigidity such as a sintered ultra high molecular weight polyethylene. Specifically, the image nib may be made of the same material and made by the same company as noted above for image nib 160.

Figure 6A:
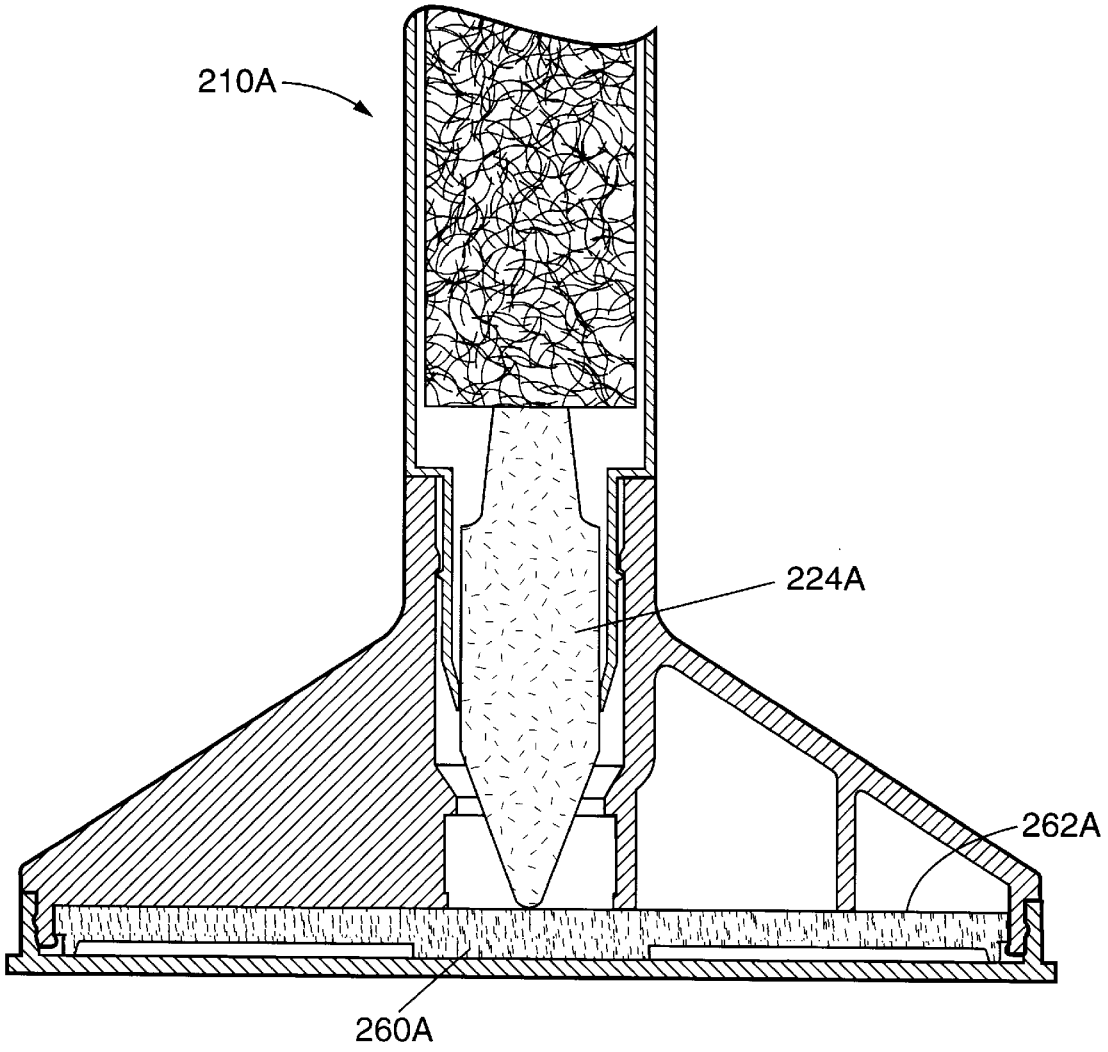
FIG. 6A is a cross-sectional view of another embodiment of the stamping device in accordance with the present invention.
Figure 6B:
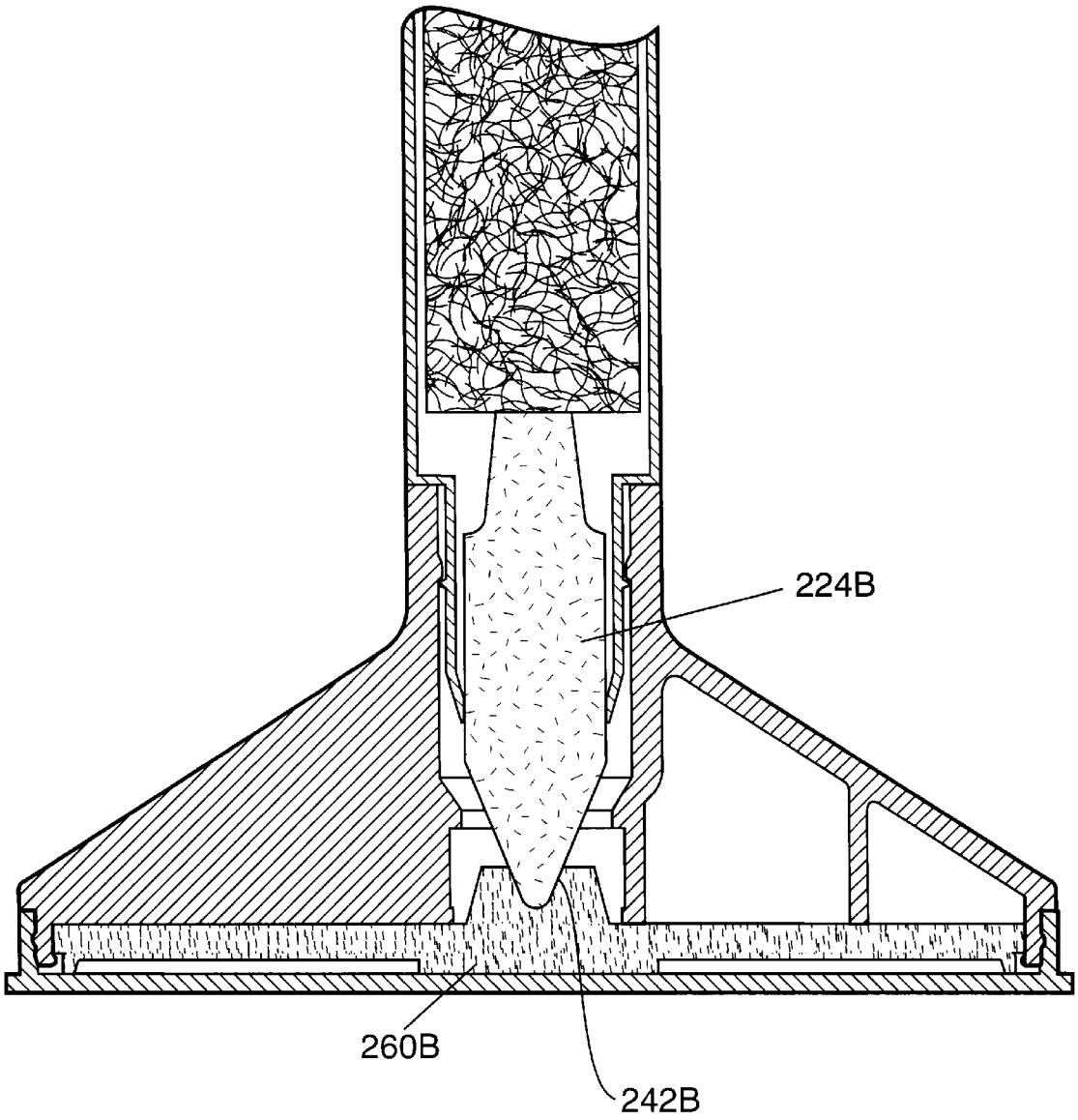
FIG. 6B is a cross-sectional view of another embodiment of the stamping device in accordance with the present invention.
Figure 6C:
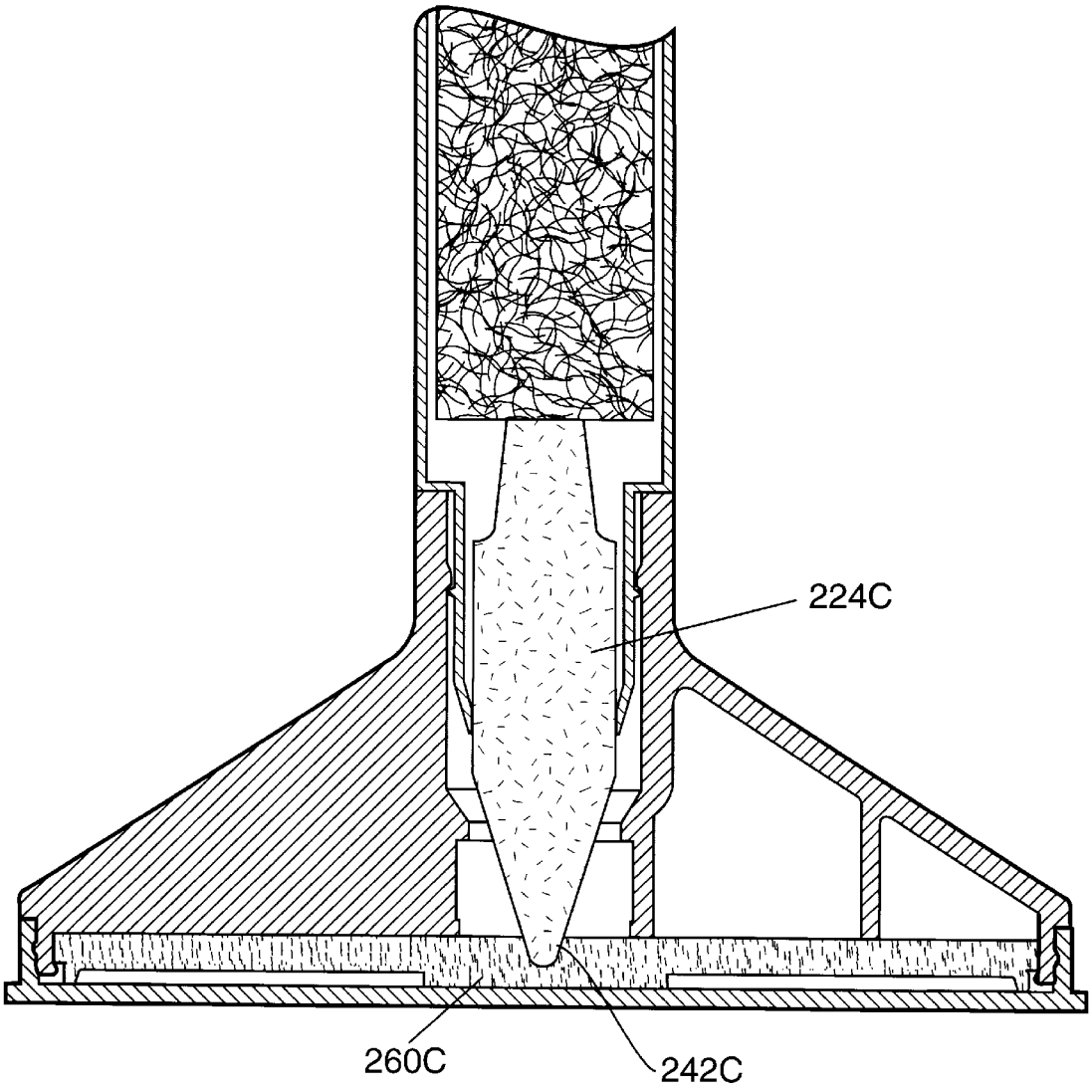
FIG. 6C is a cross-sectional view of another embodiment of the stamping device in accordance with the present invention.

The elongated platform 264 may, however, be formed of different material than the image nib 260. For example, the elongated platform 264 may be formed of the same material as the transfer medium 140 of the first embodiment (e.g., polyester fiber) and then fixedly secured to the inwardly projecting face portion 262 of image nib 260. In these embodiments the elongated platform 264 provides a surface where the marking nib 224 of the writing instrument 210 contacts the image nib 260 when the writing instrument 10 is inserted into the first end 231 of the passageway 230. In another embodiment as shown in FIG. 6A, the image nib 260A will not include a platform and the image nib 260A will have a relatively flat face portion 262A. The marker nib 224A will contact the image nib 260A when the writing instrument 210A is inserted into the stamping device. In other embodiments shown in FIGS. 6B and 6C, the image nibs 260B, 260C include indentations 242B, 242C which correspond to the shape of the marking nib 224B, 224C. In yet another embodiment, the image nib does not include the indentations and the image nib is sufficiently pliant to accept the marking nib in a fashion similar to FIGS. 6B and 6C.

Referring to FIG. 6, the image nib 260 is generally disk-shaped in configuration. The image nib 260 is attached to the housing 220 via a slight interference fit between the outer diameter of the image nib 260 and the inner diameter of the second end 222 of the housing 220. The image nib 260 includes an outwardly projecting face portion 272 with at least one raised image formed thereon. In order to prevent evaporation of ink when the stamping device 200 is not in use, a lid 280 may also be provided for replaceably covering the image nib 260.

In use, the second embodiment of the image nib 260 becomes saturated with ink from the writing instrument 210 after the marking nib 224 of the writing instrument 210 has been in contact with the image nib 260 for a sufficient time duration. Once saturated, the outwardly projecting face portion 272 of the image nib 260 may be pressed against an external object so as to imprint inked replicas of the raised images thereon.

Figure 7:
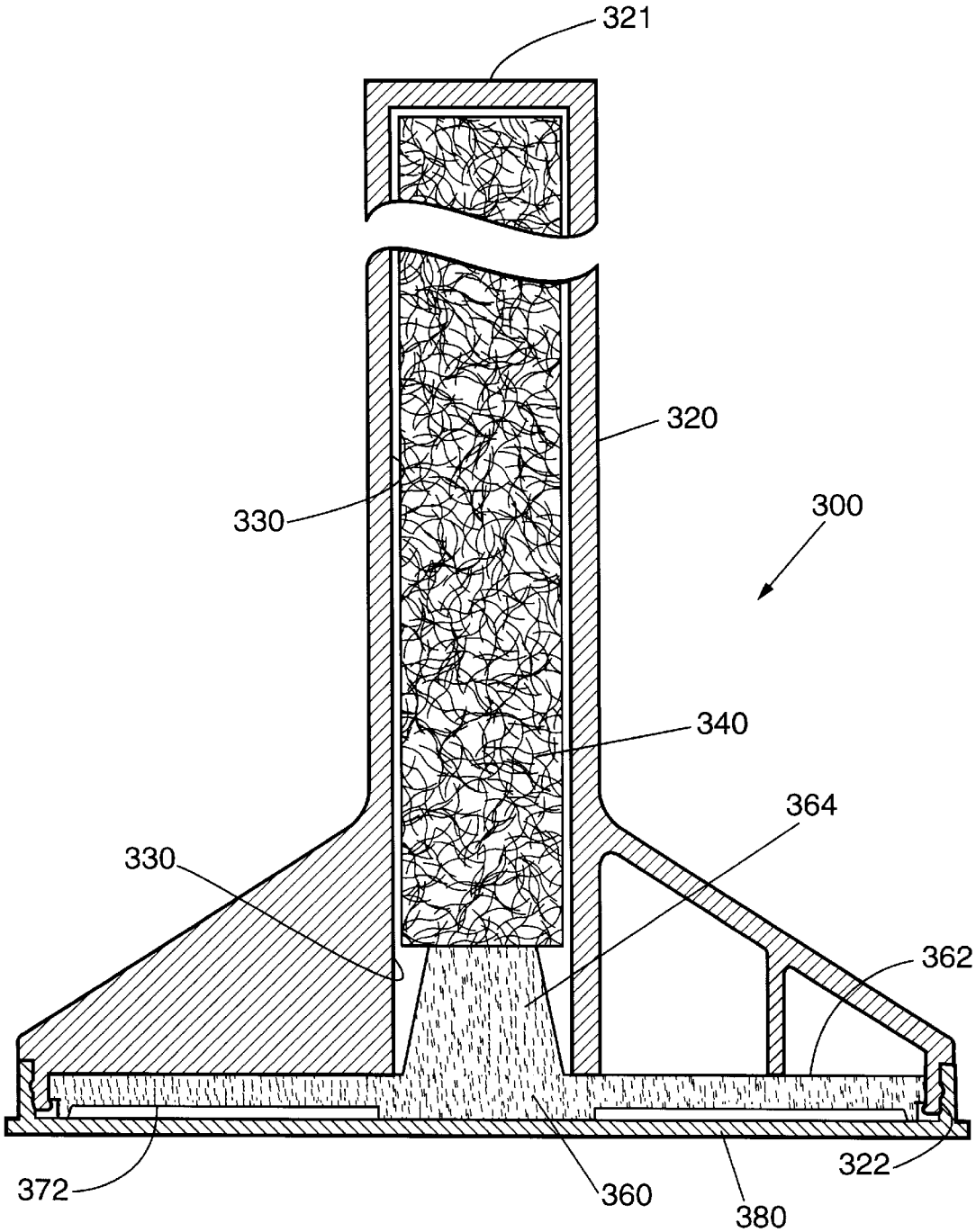
FIG. 7 is a cross-sectional view of another embodiment of the stamping device in accordance with the present invention.

Another embodiment of the stamping device 300 is illustrated in FIG. 7. In this embodiment, the stamping device 300 includes an elongated body 320 formed of plastic or other suitable material with a closed first end 321, and open second end 322, and a reservoir 330 therebetween. The stamping device 300 includes an image nib 360 having an inwardly projecting face portion 362 with an elongated platform 364 formed thereon and an outwardly projecting face portion 372 with at least one raised image formed thereon. As in the previous embodiments, the image nib 360 may be formed of a relatively rigid and highly absorbent material such as a sintered ultra high molecular weight polyethylene or any other material which provides suitable capillary action and structural rigidity. Specifically, the image nib may be made of the same material and made by the same company as noted above for image nib 160.

An ink-saturated core 340 is also provided for supplying ink to the image nib 360. As shown in FIG. 7, the core 340 is disposed within the reservoir 330 of the body 320 in contact with the elongated platform 364 of the image nib 360 is provided for supplying ink to the image nib 360. The core 340 may be formed of a highly absorbent material such as felt, cellulose fiber, or the like.

In order to provide a stable foundation for the stamping device 300 and to accommodate large images, the second end 322 of the body 320 is appreciably wider than the first end 321 of the body 320. In addition, a lid 380 may also be provided for selectively covering the image nib 360 when the stamping device 300 is not in use.

Because the image nib 360 is in contact with the ink-saturated core 340, the image nib 360 is ordinarily saturated with ink. Therefore, inked replicas of the raised images formed on the outwardly projecting face portion 372 of the image nib 360 may be conveniently imprinted on an external object. The user would remove the lid 380 to expose the image nib 360 and then press the outwardly projecting face portion 372 of the image nib 360 against the external object.

Figure 7A:
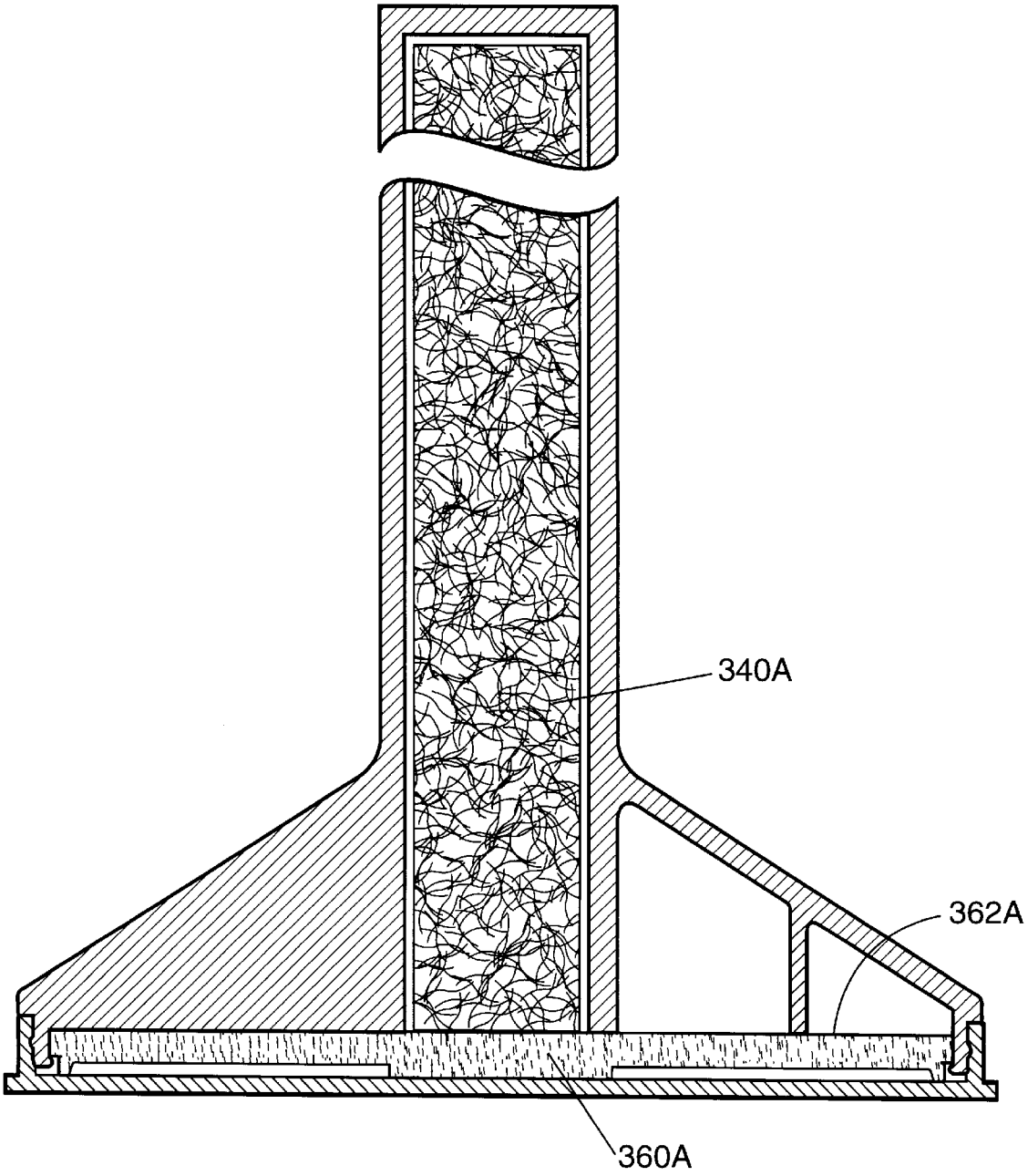
FIG. 7A is a cross-sectional view of another embodiment of the stamping device in accordance with the present invention.

In another embodiment of the stamping device as shown in FIG. 7A, the image nib 360A will not include a platform and the image nib will have a relatively flat face portion 362A. The core 340A will contact the image nib 360A.

Figure 8:
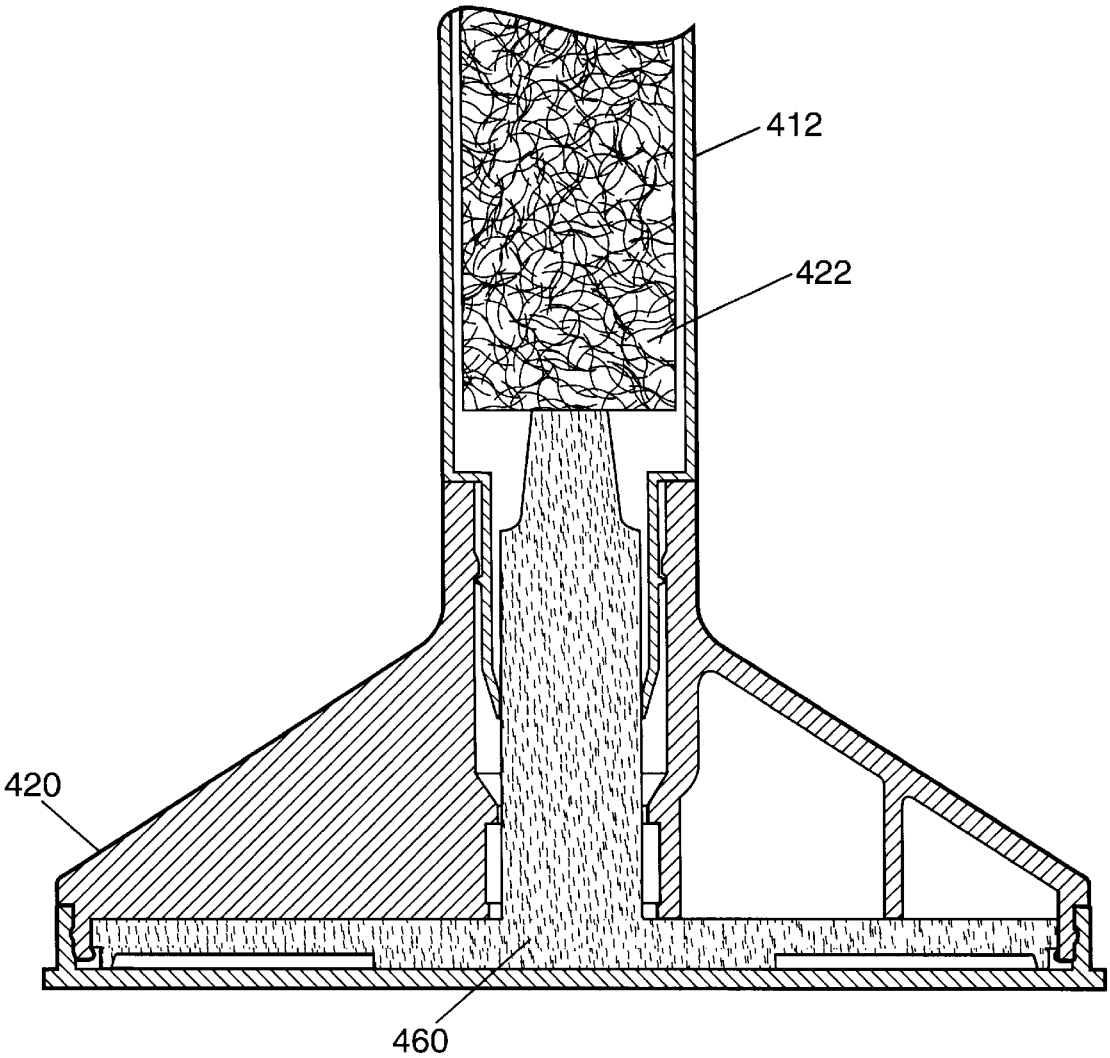
FIG. 8 is a cross-sectional view of another embodiment of the stamping device in accordance with the present invention.

In an additional embodiment of the stamping device as shown in FIG. 8, the image nib and the marking nib are combined to form the image nib 460. The stamping device includes a barrel 412, a core 422 and a housing 420 similar to the barrel, the core and the housing in FIG. 2. The nib 460 engages the barrel 412 and the nib 460 also contacts the core 422. The nib 460 may be made of the same material and made by the same company as the nib 360 noted above.

Figure 9:
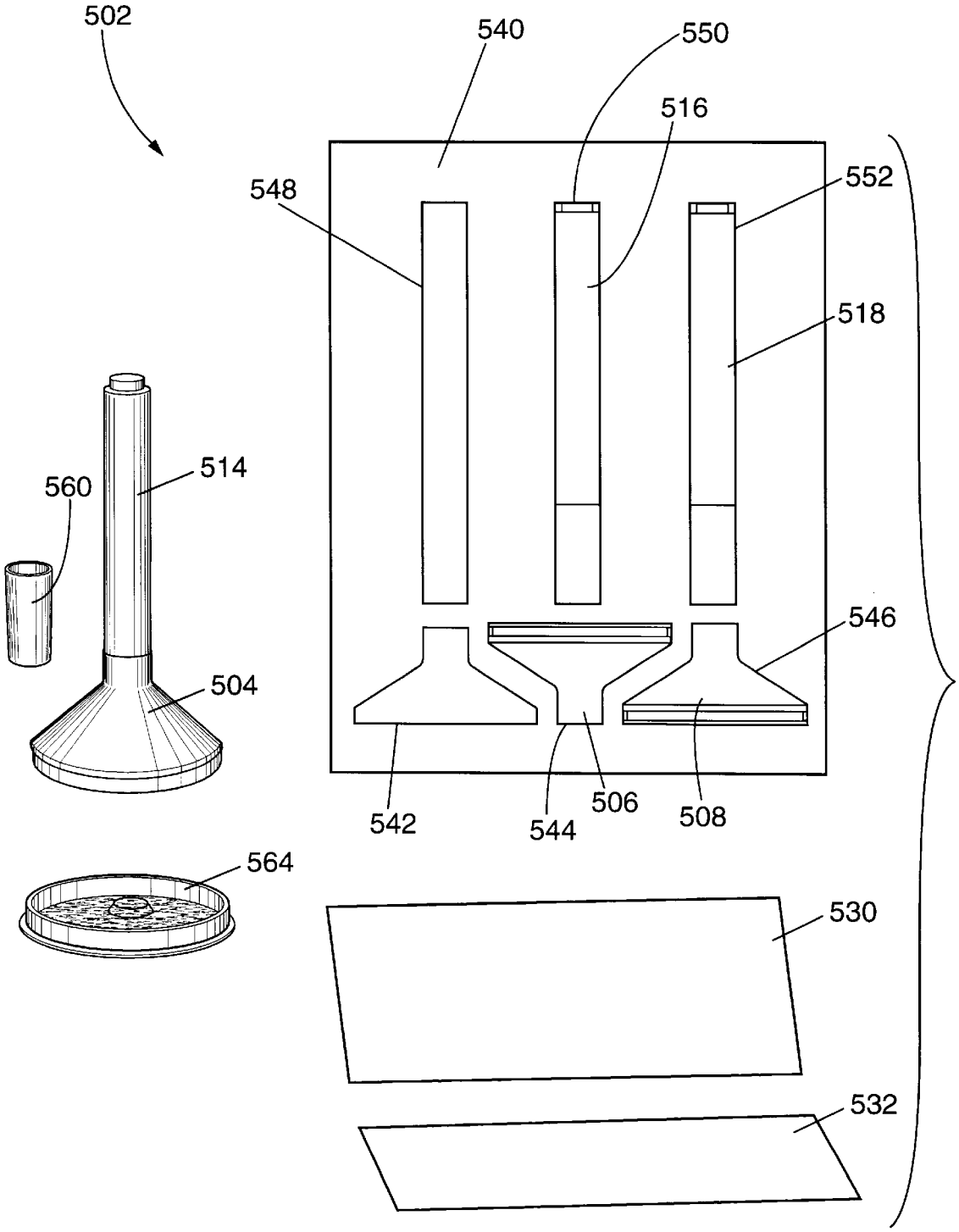
FIG. 9 is a perspective view of a kit including the stamping device in accordance with the invention.

Referring to FIG. 9, a kit is shown which includes a stamping device. Specifically, the kit 502 includes three stamping devices 504, 506, 508, three markers 514, 516, 518, one or more sheets of paper 530, 532, and a container 540 for these items. The container 540 may be a blister package which includes compartments 542, 544, 546 for the stamping devices and compartments 548, 550, 552 for the markers. As shown in FIG. 9, the marker 514 has been removed from the compartment 548 and the stamping device 504 has been removed from the compartment 542. In addition, the cap 560 has been removed from the marker 514 and the marker 514 has been assembled to the stamping device 504. Also, the lid 564 has been removed from the stamping device 504. Each stamping device would have a different image but the images may relate to the same theme.

Figure 10:
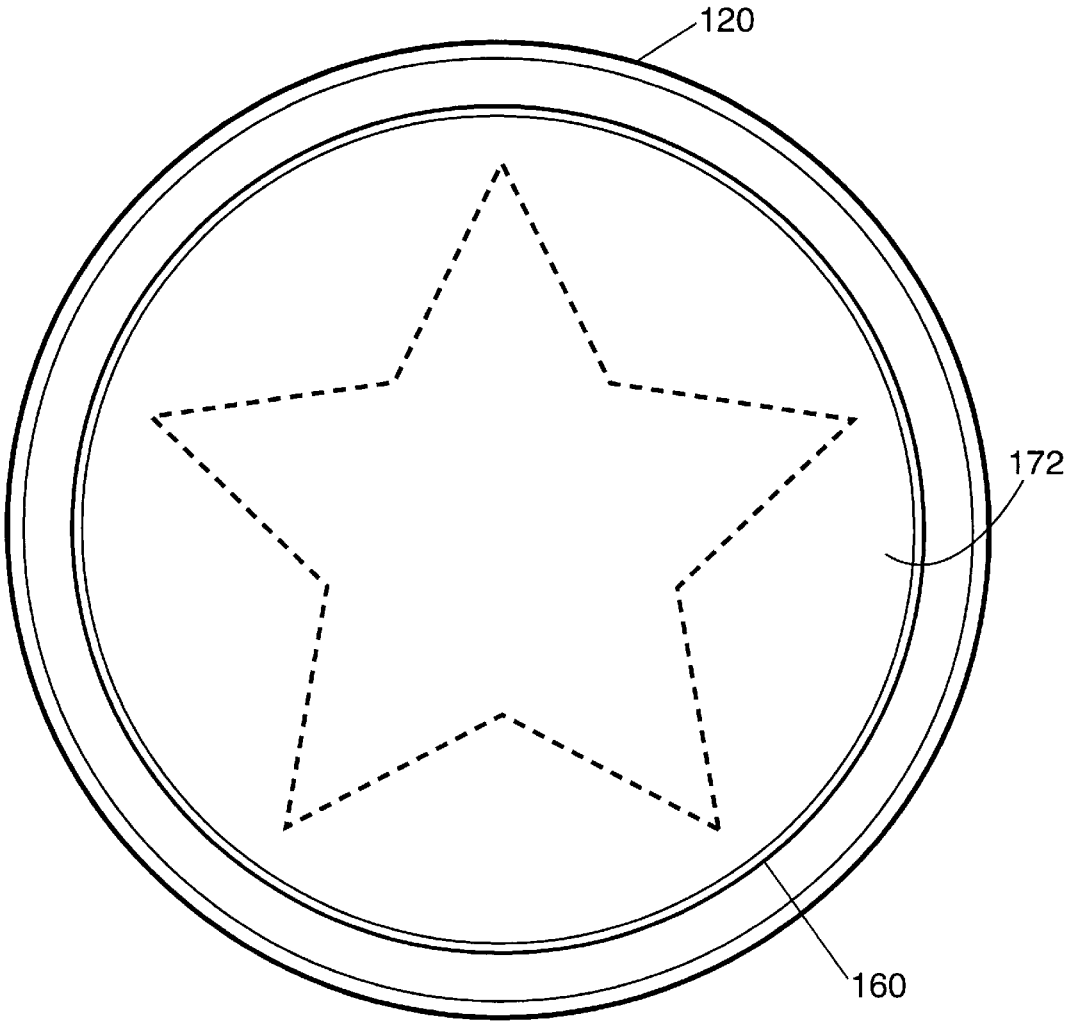
FIG. 10 is a bottom view of the stamping device shown in FIG. 1 with the image shown in dashed lines.

Referring to FIG. 10, a bottom view of the stamping device is shown with the image drawn in dashed lines. As noted above, each stamping device may include a different image.

Figure 11:
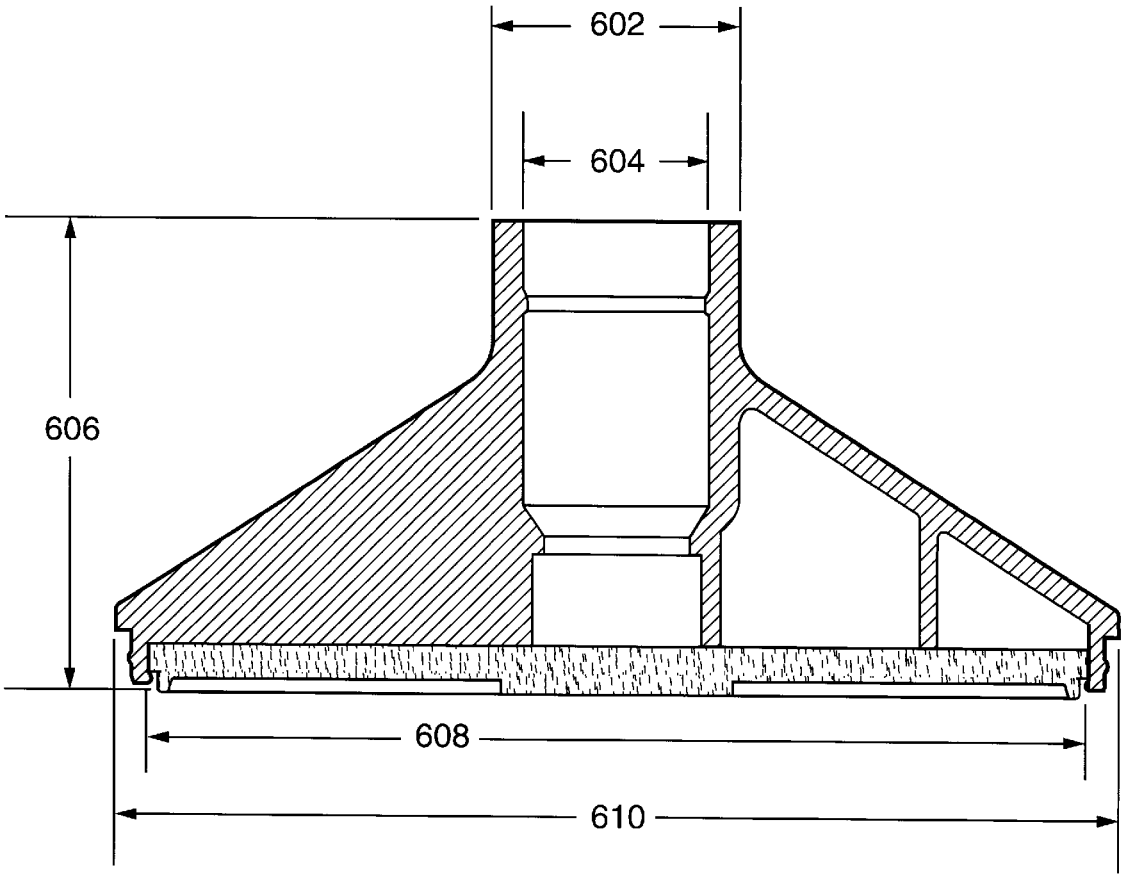
FIG. 11 is a cross-sectional view with dimensional parameters.
Figure 12A:
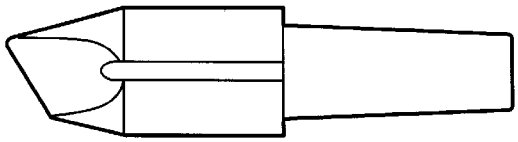
FIGS. 12A–12G are side views of various marker nibs.
Figure 12B:
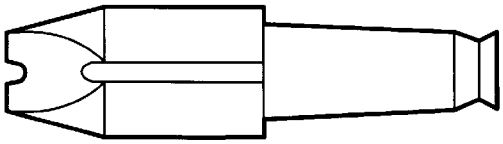
Figure 12C:
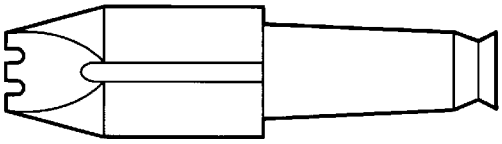
Figure 12D:
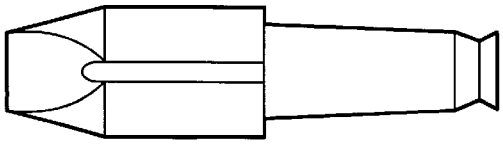
Figure 12E:
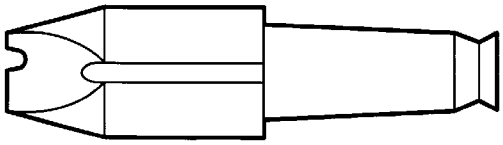
Figure 12F:
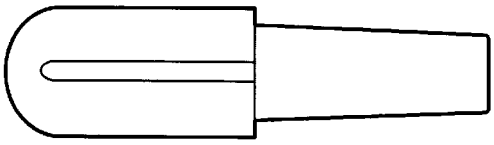
Figure 12G:
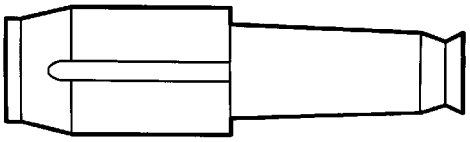

Referring to FIG. 11, the representative dimensions of various parameters are given as follows:

| Parameter | Preferred (Inches) | Range (Inches) |
|---|---|---|
| 602 | .568 | .200–2.0 |
| 604 | .461 | .093–1.893 |
| 606 | 1.055 | .5275–4.00 |
| 608 | 1.847 | .250–6.0 |
| 610 | 2.0 | .403–6.153 |

In other embodiments, the ratio of parameter 604 to parameter 608 may be approximately in the first range of 10:1 to 1:20 and in a second range of 1:2 to 1:8 and preferably the ratio of 1:4.

FIGS. 12A–12G illustrate various marking nibs which may be used with the stamping device. The nib in FIG. 12A has a slanted wedge tip, the nib in FIG. 12B has a 2 line tip, the nib in FIG. 12C has a 3 line tip, the nib in FIG. 12D has a wedge tip, the nib in FIG. 12E has a 2 line (thick and thin) tip, the nib in FIG. 12F has a gum drop tip and the nib in FIG. 12G has a small stamp tip.

While the present invention has been described and disclosed with an emphasis upon these embodiments, it will be understood, of course, that the present invention is not strictly limited thereto. Since modifications may be made to the structures disclosed herein—particularly in light of the foregoing teachings—without departing from the present invention, the following claims are intended to cover all structures that fall within the scope and spirit of the present invention.

What is claimed is:

1. A stamping device for imprinting images on an external object with ink from a writing instrument, the stamping device comprising, in combination:

a housing having a first end, a second end, and a passageway therebetween, the passageway having first and second ends which correspond to the first and second ends of the housing, respectively, the first end of the passageway adapted to receive a marking nib of a writing instrument;

an image nib attached to the second end of the housing, the image nib including an outwardly projecting face portion with at least one raised image formed thereon; and a transfer medium disposed at least partially within the passageway of the housing and positioned for communication with the image nib, the transfer medium also positioned for communication with a marking nib of a writing instrument when a marking nib is received by first end of the passageway, the transfer medium transferring ink from a marking nib of a writing instrument to the image nib when a marking nib is received by the first end of the passageway, the image nib adapted to transfer an inked reproduction of said at least one raised image to an external object when the image nib is saturated with ink and the outwardly projecting face portion of the image nib is pressed against the external object.

2. The invention set forth in claim 1, wherein the housing is formed of plastic.

3. The invention set forth in claim 1, wherein the transfer medium is formed of absorbent material.

4. The invention set forth in claim 1, wherein the transfer medium is formed of a porous polyester fiber material.

5. The invention set forth in claim 1, wherein the image nib is formed of sintered polyethylene.

6. The invention set forth in claim 1, wherein the image nib is formed of a sintered ultra high molecular weight polyethylene.

7. The invention set forth in claim 1, wherein the second end of the housing is wider than the first end of the housing.

8. The invention set forth in claim 1, wherein the image nib includes an inwardly projecting face portion with a platform formed thereon.

9. The invention set forth in claim 1, wherein said at least one raised image includes texturing for preventing puddling of ink.

10. The invention set forth in claim 1, further comprising:

a lid removably attachable to the second end of the housing for preventing evaporation of ink when the stamping device is not in use.

11. The invention set forth in claim 1, wherein the first end of the passageway is adapted to removably receive a marking nib of a writing instrument.

12. The invention set forth in claim 1, wherein the transfer medium is fixedly attached to the image nib.

13. The invention set forth in claim 1, wherein a portion of said image nib is disk shaped.

14. A stamping device for imprinting images on an external object with ink from a writing instrument, the stamping device comprising, in combination:

a housing having a first end, a second end, and a passageway therebetween, the passageway having first and second ends which correspond to the first and second ends of the housing, respectively, the first end of the passageway adapted to receive a marking nib of a writing instrument; and an image nib attached to the second end of the housing, the image nib including an inwardly projecting face portion and an outwardly projecting face portion with at least one raised image formed thereon, the inwardly projecting face portion of the image nib positioned for communication with a marking nib of a writing instrument when a marking nib is received by the first end of the passageway, the image nib adapted to transfer an inked reproduction of said at least one raised image to an external object when the image nib is saturated with ink from a writing instrument and the outwardly projecting face portion of the image nib is pressed against the external object.

15. The invention set forth in claim 14, wherein the housing is formed of plastic.

16. The invention set forth in claim 14, wherein the image nib is formed of sintered ultra high molecular weight polyethylene.

17. The invention set forth in claim 14, wherein the second end of the housing is wider than the first end of the housing.

18. The invention set forth in claim 14, wherein the inwardly projecting face portion of the image nib includes a platform for communicating with a marking nib of a writing instrument when a marking nib is received by the first end of the passageway.

19. The invention set forth in claim 14, wherein said at least one raised image includes texturing for preventing puddling of ink.

20. The invention set forth in claim 14, further comprising:

a lid removably attachable to the second end of the housing for preventing evaporation of ink when the stamping device is not in use.

21. The invention set forth in claim 14, wherein the first end of the passageway is adapted to removably receive a marking nib of a writing instrument.

22. The invention set forth in claim 14, wherein a portion of said image nib is disk shaped.

23. A stamping kit for imprinting images on an external object comprising:

a writing instrument having a marking nib; and a stamping device including a housing having a first end, a second end, and a passageway therebetween, the passageway having first and second ends which correspond to the first and second ends of the housing, respectively, the first end of the passageway adapted to receive a marking nib of a writing instrument, an image nib attached to the second end of the housing, the image nib including an inwardly projecting face portion and an outwardly projecting face portion with at least one raised image formed thereon, the inwardly projecting face portion of the image nib positioned for communication with the marking nib of the writing instrument when the marking nib is received by first end of the passageway, the image nib adapted to transfer an inked reproduction of said at least one raised image to an external object when the image nib is saturated with ink from the writing instrument and the outwardly projecting face portion of the image nib is pressed against the external object.

24. The invention as in claim 23 further comprising a container for said writing instrument and said stamping device.

25. The invention as in claim 24 wherein said container is a blister package.

26. The invention as in claim 24, comprising three of said writing instrument and three of said stamping device.

27. The invention set forth in claim 23 wherein said at least one raised image of the image nib includes texturing.

28. A method for using a stamping kit for imprinting images on an external object comprising the steps of:

providing a writing instrument having a marking nib;

providing a stamping device including a housing having a first end, a second end, and a passageway therebetween, the passageway having first and second ends which correspond to the first and second ends of the housing, respectively, the first end of the passageway adapted to receive a marking nib of a writing instrument, an image nib attached to the second end of the housing, the image nib including an inwardly projecting face portion and an outwardly projecting face portion with at least one raised image formed thereon, the inwardly projecting face portion of the image nib positioned for communication with the marking nib of a writing instrument when a marking nib is received by first end of the passageway, the image nib adapted to transfer an inked reproduction of said at least one raised image to an external object when the image nib is saturated with ink from a writing instrument and the outwardly projecting face portion of the image nib is pressed against the external object;

inserting said marking nib into said passageway; and pressing the image nib against an external object.

29. The invention as in claim 28 further comprising the steps of:

providing a first cap for the marking nib; and removing the first cap from the marking nib.

30. The invention as in claim 29 further comprising the steps of:

providing a second cap for the image nib; and removing the second cap from the image nib.

31. The invention set forth in claim 28 further comprising the step of:

providing texturing on said at least one raised image of the image nib.

* * * * *